US008463117B2

(12) United States Patent
Yeung

(10) Patent No.: US 8,463,117 B2
(45) Date of Patent: Jun. 11, 2013

(54) WATER HEATING APPARATUS

(75) Inventor: Wing Yiu Yeung, Hong Kong (HK)

(73) Assignee: Advanced Materials Enterprises Company Limited, Hong Kong (HK)

( * ) Notice: Subject to any disclaimer, the term of this patent is extended or adjusted under 35 U.S.C. 154(b) by 741 days.

(21) Appl. No.: 12/641,289

(22) Filed: Dec. 17, 2009

(65) Prior Publication Data

US 2010/0092163 A1 Apr. 15, 2010

Related U.S. Application Data

(63) Continuation-in-part of application No. 12/489,465, filed on Jun. 23, 2009, now Pat. No. 8,346,069.

(60) Provisional application No. 61/075,008, filed on Jun. 24, 2008.

(51) Int. Cl.
*F24H 1/10* (2006.01)
*H05B 3/78* (2006.01)

(52) U.S. Cl.
USPC ..... 392/491; 392/465; 392/492; 392/493; 392/494

(58) Field of Classification Search
None
See application file for complete search history.

(56) References Cited

U.S. PATENT DOCUMENTS

| | | | | | |
|---|---|---|---|---|---|
| 941,215 | A * | 11/1909 | Wade | 392/494 |
| 1,138,593 | A * | 5/1915 | Mosteller | 392/473 |
| 1,385,564 | A * | 7/1921 | Luehrs | 392/491 |
| 1,850,156 | A * | 3/1932 | Richardson | 392/492 |
| 1,985,830 | A * | 12/1934 | Hynes | 392/492 |
| 3,982,100 | A * | 9/1976 | Hervert | 219/553 |
| 4,436,058 | A * | 3/1984 | McAlister | 122/19.1 |
| 4,692,592 | A * | 9/1987 | Kale | 392/450 |
| 5,408,574 | A * | 4/1995 | Deevi et al. | 392/404 |
| 5,438,642 | A * | 8/1995 | Posen | 392/485 |
| 5,872,891 | A * | 2/1999 | Son | 392/492 |
| 6,282,371 | B1 * | 8/2001 | Martin et al. | 392/490 |
| 6,816,670 | B1 * | 11/2004 | Renau | 392/467 |
| 7,035,532 | B2 * | 4/2006 | Kudo | 392/341 |
| 7,760,993 | B2 * | 7/2010 | You | 392/494 |
| 7,796,868 | B2 * | 9/2010 | Kaastra | 392/465 |
| 7,946,300 | B2 * | 5/2011 | Kim et al. | 134/105 |
| 2008/0089676 | A1 * | 4/2008 | Schubert et al. | 392/478 |
| 2009/0060481 | A1 * | 3/2009 | Kaastra | 392/471 |

* cited by examiner

*Primary Examiner* — Thor Campbell

(57) ABSTRACT

A water heating apparatus includes a water tank having a plurality of sidewalls, a main heating member mounted inside and across the water tank, and at least one secondary heating or partition member extending between the main heating member and the sidewalls to form at least one water compartment with a water path. At least one tertiary heating member is provided on the inner surface of the water tank. The partition member can be spiral in shape. Each heating member has at least a multi-layer conductive coating of nano-thickness deposited thereon, and electrodes coupled to the multi-layer conductive coating. The multi-layer conductive coating comprises a structure and composition which stabilize performance of the heating member at high temperature.

25 Claims, 17 Drawing Sheets

WATER HEATING APPARATUS

RELEVANT PATENT APPLICATIONS

The present patent application is a continuation-in-part application of U.S. patent non-provisional application Ser. No. 12/489,465 filed on Jun. 23, 2009, now U.S. Pat. No. 8,346,069 which claims benefit of U.S. Patent Provisional Application No. 61/075,008, filed on Jun. 24, 2008; the entirety of which are incorporated herein by reference.

FIELD OF PATENT APPLICATION

The present patent application relates to a water heating apparatus.

BACKGROUND

An integrated coating system has been disclosed in U.S. patent application Ser. No. 12/026,724, which is incorporated herein by reference to the extent necessary to understand and/or practice the water heating apparatus claimed in the present patent application. This integrated coating system is developed to produce reliable high temperature heating elements capable of performing reliable and consistent heating functions up to about 600° C. The coating system is deposited on a flat ceramic glass substrate and includes multi-layers of conductive coatings of nano-thickness of proprietary base chemistry, doped elements and process conditions, with capacity to maintain stable structure and performance at high temperature heating. The coating system further includes specially formulated ceramic frit parallel electrodes formed across the coatings to ensure optimum matching between the electrodes and the coatings and the substrate in reducing electric resistance and improving conductivity across the heating element.

A conductive coating material is used to convert electric power into heat energy. The heat generation principle as used is very different from conventional coil heating in which heating outputs come from the resistance of the metal coils with low heating efficiency and high power loss. In contrast, by adjusting the composition and thickness of the layers of coating, electric resistance of the coating system can be controlled and conductivity can be increased to generate high efficiency heating with minimal energy loss. An integrated coating system has been developed to produce reliable high temperature heating elements capable of performing reliable and consistent heating functions up to about 600° C. An intelligent power monitor and control system using analog-to-digital converter (ADC) and pulse-width modulation (PWM) drives integrated with the heating films can be provided in smoothing the power supply to the heating elements and optimizing their heating performance and energy saving efficiency in accordance with the required water temperature and flow rate.

The above description of the background is provided to aid in understanding a water heating apparatus, but is not admitted to describe or constitute pertinent prior art to the water heating apparatus disclosed in the present application, or consider any cited documents as material to the patentability of the claims of the present application.

SUMMARY

According to one aspect, there is provided a water heating apparatus including:

a water tank having a plurality of sidewalls;

a first heating member mounted inside and across the water tank, the first heating member being in the form of a flat plate having opposite first and second surfaces;

at least one second heating member resting on the first heating member and extending between and substantially perpendicular to the first heating member and the sidewalls, forming at least one water compartment with a winding water path; and at least one third heating member mounted on an inner surface of the top, bottom or sidewalls of the water heating apparatus;

each of the first, second and third heating members including:

- a heating body made of ceramic glass in the form of a flat plate;
- at least a multi-layer conductive coating of nano-thickness deposited on the heating body; and
- electrodes coupled to the multi-layer conductive coating, wherein the multi-layer conductive coating includes a structure and composition which stabilize performance of the heating members at high temperature.

In one embodiment, the water heating apparatus includes at least two second heating members provided on the two opposite surfaces of the first heating member, forming two water compartments with two winding water paths respectively.

In one embodiment, the two water compartments are in fluid communication with each other by an opening provided on the first heating member, forming a continuing winding water path doubling the length of the water path of a single water compartment.

In one embodiment, each of the first, second and third heating members includes a plurality of conductive coatings electrically connected to one another in series or in parallel.

According to another aspect, there is provided a water heating apparatus including:

a water tank having a plurality of sidewalls;

a first heating member mounted inside and across the water tank, the heating member being in the form of a flat plate having opposite first and second surfaces;

at least one spiral second heating member resting on the first heating member and extending between and substantially perpendicular to the first heating member and the sidewalls, forming at least one water compartment with a spiral water path;

at least one third heating member mounted on an inner surface of the top, bottom or sidewalls of the water heating apparatus;

each of the first, second and third heating members including:

- a heating body made of ceramic glass;
- at least a multi-layer conductive coating of nano-thickness deposited on the heating body; and
- electrodes coupled to the multi-layer conductive coating, wherein the multi-layer conductive coating includes a structure and composition which stabilize performance of the heating members at high temperature.

In one embodiment, the water heating apparatus further includes a pipe with one end being connected to an innermost end of the spiral second heating member and in fluid communication with the water compartment by a side opening formed on the pipe, and wherein the pipe defines a water inlet and an outermost end of the spiral second heating member defines a water outlet of the water tank.

In one embodiment, the water heating apparatus includes two spiral second heating members provided on the two opposite surfaces of the first heating member, forming two water compartments with two spiral water paths respectively.

In one embodiment, the two water compartments are in fluid communication with each other by an opening provided on the first heating member, forming a continuing spiral water path doubling the length of water path of a single water compartment.

In one embodiment, the water heating apparatus further includes a first pipe with one end being connected to an innermost end of one spiral second heating member and in fluid connection communication with one corresponding water compartment through a side opening formed on the first pipe; and a second pipe with one end being connected to an innermost end of the other spiral second heating member and in fluid communication with the other corresponding water compartment through a side opening formed on the second pipe, wherein the first pipe defines a water inlet and the second pipe defines a water outlet of the water tank.

In one embodiment, each of the first, second and third heating members includes a plurality of conductive coatings electrically connected to one another in series or in parallel.

In one embodiment, the water tank is generally cylindrical in shape and the first heating member is generally circular in shape.

According to yet another aspect, there is provided a water heating apparatus including:

a water tank comprising a plurality of sidewalls;

a first heating member mounted inside and across the water tank, the first heating member being in the form of a flat plate comprising opposite first and second surfaces;

at least one partition member resting on the first heating member and extending between the first heating member and the sidewalls to form at least one water compartment with a water path;

wherein the first heating member includes:

a heating body;

at least a multi-layer conductive coating of nano-thickness deposited on the heating body; and electrodes coupled to the multi-layer conductive coating, wherein the multi-layer conductive coating comprises a structure and composition which stabilize performance of the heating member at high temperature.

In one embodiment, the partition member includes a second heating member, which includes:

a heating body;

at least a multi-layer conductive coating of nano-thickness deposited on the heating body; and electrodes coupled to the multi-layer conductive coating, wherein the multi-layer conductive coating comprises a structure and composition which stabilize performance of the heating member at high temperature.

In one embodiment, the water heating apparatus further includes at least one third heating member mounted on an inner surface of the sidewalls, wherein the third heating member includes:

a heating body;

at least a multi-layer conductive coating of nano-thickness deposited on the heating body; and electrodes coupled to the multi-layer conductive coating, wherein the multi-layer conductive coating comprises a structure and composition which stabilize performance of the heating member at high temperature.

In one embodiment, each of the first, second and third heating members includes a plurality of conductive coatings electrically connected to one another in series or in parallel.

In one embodiment, the water heating apparatus includes one partition member resting on the first heating member and forming a generally n-shaped water path in the water tank.

In one embodiment, the water heating apparatus includes a plurality of partition members resting on the first heating member and arranged parallel to one another forming a winding water path in the water tank.

In one embodiment, the water tank is generally cylindrical in shape and the first heating member is generally circular in shape.

In one embodiment, the water heating apparatus includes at least two partition members provided on the two opposite surfaces of the first heating member, forming two water compartments with two water paths respectively.

In one embodiment, the two water compartments are in fluid communication with each other by an opening provided on the first heating member, forming a continuing water path doubling the length of the water path of a single water compartment.

In one embodiment, the at least one partition member is spiral in shape forming at least one water compartment with a spiral water path.

In one embodiment, the water heating apparatus further includes a pipe with one end being connected to an innermost end of the spiral partition member and in fluid communication with the water compartment by a side opening formed on the pipe, and wherein the pipe defines a water inlet and an outermost end of the spiral partition member defines a water outlet of the water tank.

In one embodiment, the water heating apparatus includes two spiral partition members provided on the two opposite surfaces of the heating member, forming two water compartments with two spiral water paths respectively.

In one embodiment, the two water compartments are in fluid communication with each other by an opening provided on the heating member, forming a continuing spiral water path doubling the length of the water path of a single.

In one embodiment, the water heating apparatus further includes a first pipe with one end being connected to an innermost end of one spiral partition member and in fluid communication with its associated compartment by a side opening formed on the first pipe; and a second pipe with one end being connected to an innermost end of the other spiral partition member and in fluid communication with its associated water compartment by means of a side opening formed on the second pipe, wherein the first pipe defines a water inlet and the second pipe defines a water outlet of the water tank.

BRIEF DESCRIPTION OF THE DRAWINGS

Specific embodiments of the water heating apparatus disclosed in the present application will now be described by way of example with reference to the following accompanying drawings.

DETAILED DESCRIPTION

Reference will now be made in detail to a preferred embodiment of the water heating apparatus disclosed in the present application, examples of which are also provided in the following description. Exemplary embodiments of the water heating apparatus disclosed in the present application are described in detail, although it will be apparent to those skilled in the relevant art that some features that are not particularly important to an understanding of the water heating apparatus may not be shown for the sake of clarity.

Furthermore, it should be understood that the water heating apparatus disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

In addition, improvements and modifications which may become apparent to persons of ordinary skill in the art after reading this disclosure, the drawings, and the appended claims are deemed within the spirit and scope of the appended claims.

It should be noted that throughout the specification and claims herein, when one element is said to be "coupled" or "connected" to another, this does not necessarily mean that one element is fastened, secured, or otherwise attached to another element. Instead, the term "coupled" or "connected" means that one element is either connected directly or indirectly to another element, or is in mechanical or electrical communication with another element.

Figure 1:
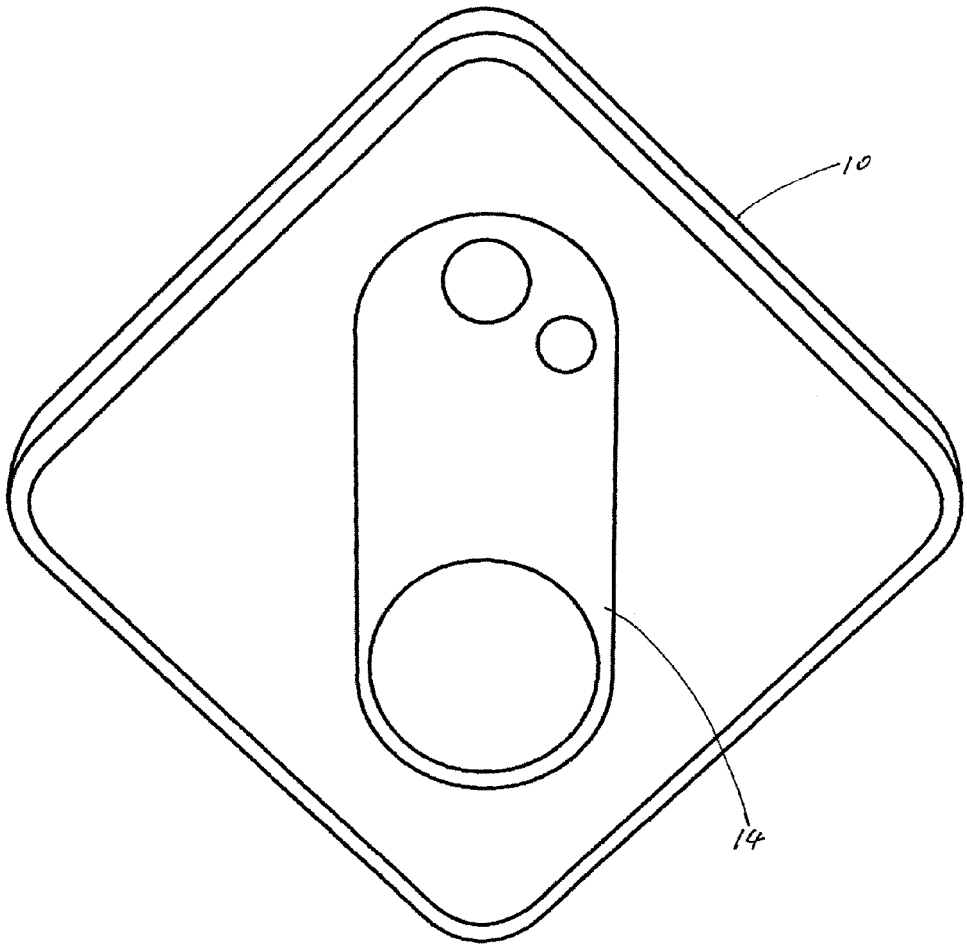
FIG. 1 is a front perspective view of a water heating apparatus with heating members mounted therein according to an embodiment disclosed in the present application.
Figure 2:
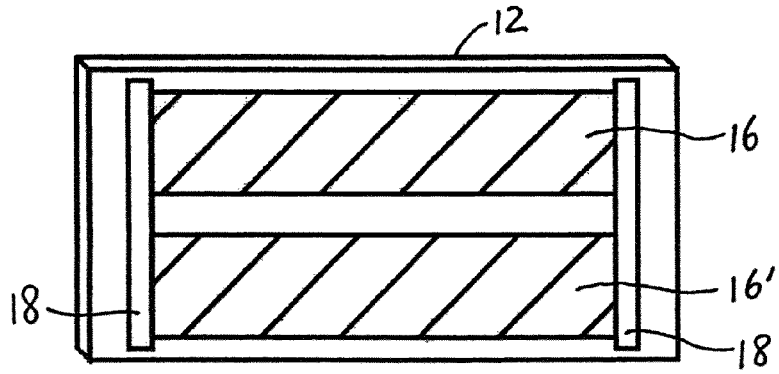
FIG. 2 is a front perspective view of a heating member with conductive coatings.

FIG. 1 shows a water heating apparatus 10 and FIG. 2 shows a heating member 12 according to an embodiment of the present patent application. The water heating apparatus 10 includes at least one heating member 12 having a heating body made of ceramic glass or other suitable materials, and a power and temperature monitor and control system 14 to control and optimize the water temperature and heating performance of the apparatus. A remote control using infra-red or other means may be added and integrated with the monitor and control system 14 of the water heating apparatus 10 to perform its design functions.

The heating body of the heating member 12 is in form of a flat plate that can maximize the heating area for efficient heating of water inside the water heating apparatus 10 and achieve a slim and compact design of the apparatus. For example, a 4 mm thick ceramic glass heating body of a size of $10\times10\ cm^2$ may provide a heating surface up to $200\ cm^2$, with direct contact water heating on the two sides of the ceramic glass. In comparison, to provide the same heating surface, a tubular heating element may require a diameter of 6.4 cm, which will restrict a slim design that the hot water apparatus can achieve.

Instead of using the conventional metallic heating elements, the heating body of the heating member 12 is made of ceramic glass with multi-layered nano-thickness heating films applied on the surface. The ceramic glass is hard and strong with high temperature resistant. The ceramic glass can perform reliable and consistent heating functions up to about 600° C., and the heating members of this application can reach 300° C. in a minute and can provide very fast instant heating when the water flows over the glass surface. The ceramic glass is also non-corrosive and can be easily cleaned by running mild acid solution through the heating system. The heating members 12 can therefore last for long service life with easy maintenance.

Each heating member 12 can produce high power rating up to 5000 W (at 220V a.c.) in a small area of $10\times10\ cm^2$. With a power density of $50\ W/cm^2$, a compact and slim-sized water heating apparatus 10 can be built with high power capacity that cannot be achieved by other conventional heating elements.

Figure 3:
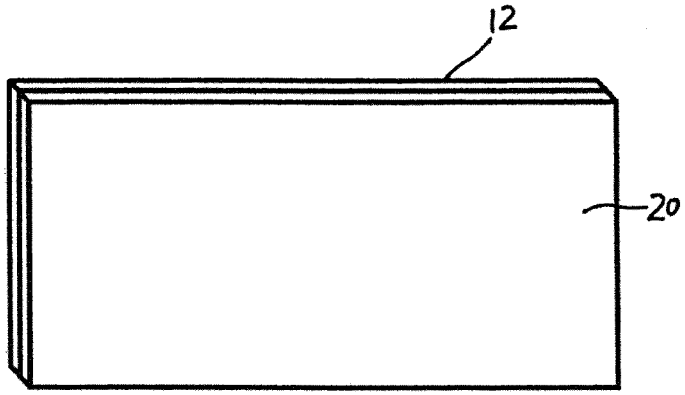
FIG. 3 is a front perspective view of the heating member of FIG. 2 being covered.

As shown in FIG. 2, multi-layered conductive coatings 16, 16' of nano-thickness of proprietary base chemistry, doped elements and process conditions, with capacity to maintain stable structure and performance at high temperature heating, and specially formulated ceramic frit electrodes 18 across the coatings are deposited on the ceramic glass heating body of heating member 12. The coating area can be covered by another ceramic glass 20 or other suitable materials for protection and insulation, as illustrated in FIG. 3. The heating member 12 is sealed and water-proof and is capable of direct contact with water.

Each heating member 12 may include one or more conductive coatings 16, 16'. Each conductive coating 16, 16' includes a coating area of heating film. If the heating member 12 includes a plurality of conductive coatings 16, 16', the conductive coatings 16, 16' may have the same size or different sizes. The conductive coatings 16, 16' may have the same coating characteristics (e.g., structure, composition, thickness, etc.) or different coating characteristics. The conductive coatings 16, 16' can be electrically connected one another in parallel or in series. With proprietary characteristics of the conductive coatings 16, 16' and the electrical connection between the conductive coatings 16, 16', improvement of conductivity and reduction of electric resistance of the conductive coatings 16, 16' to below 10 ohms can be achieved, which is capable for generating high power output over a large heating area or high power density (>10 W/cm$^2$) over a small area for efficient water heating in electric kettles, domestic and industrial hot water heaters, and other water heating apparatus.

Figure 4:
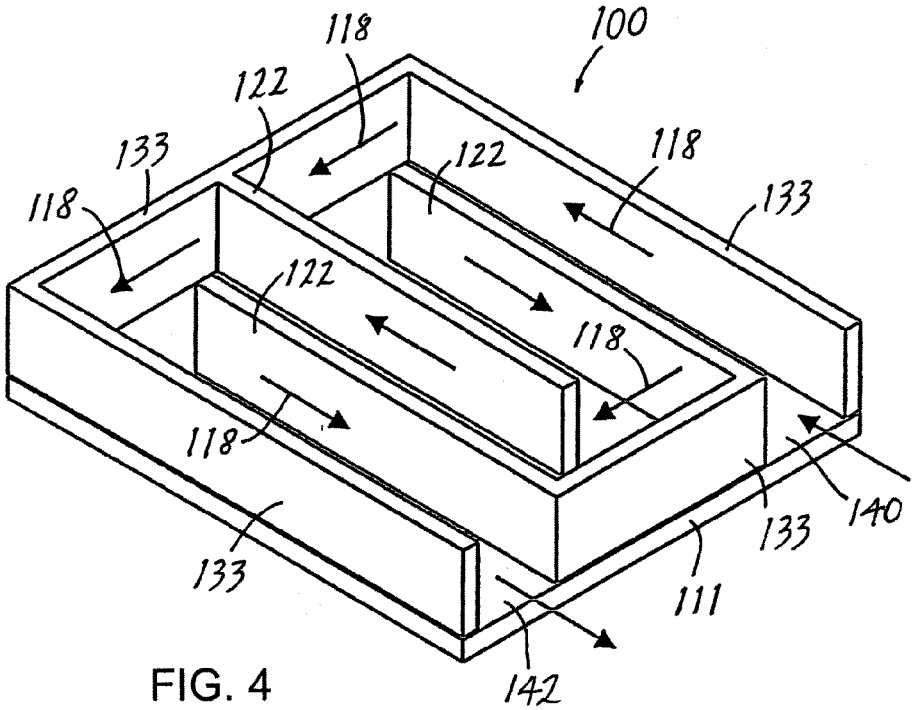
FIG. 4 is a perspective view of a single water heating compartment according to a first embodiment disclosed in the present application.
Figure 5:
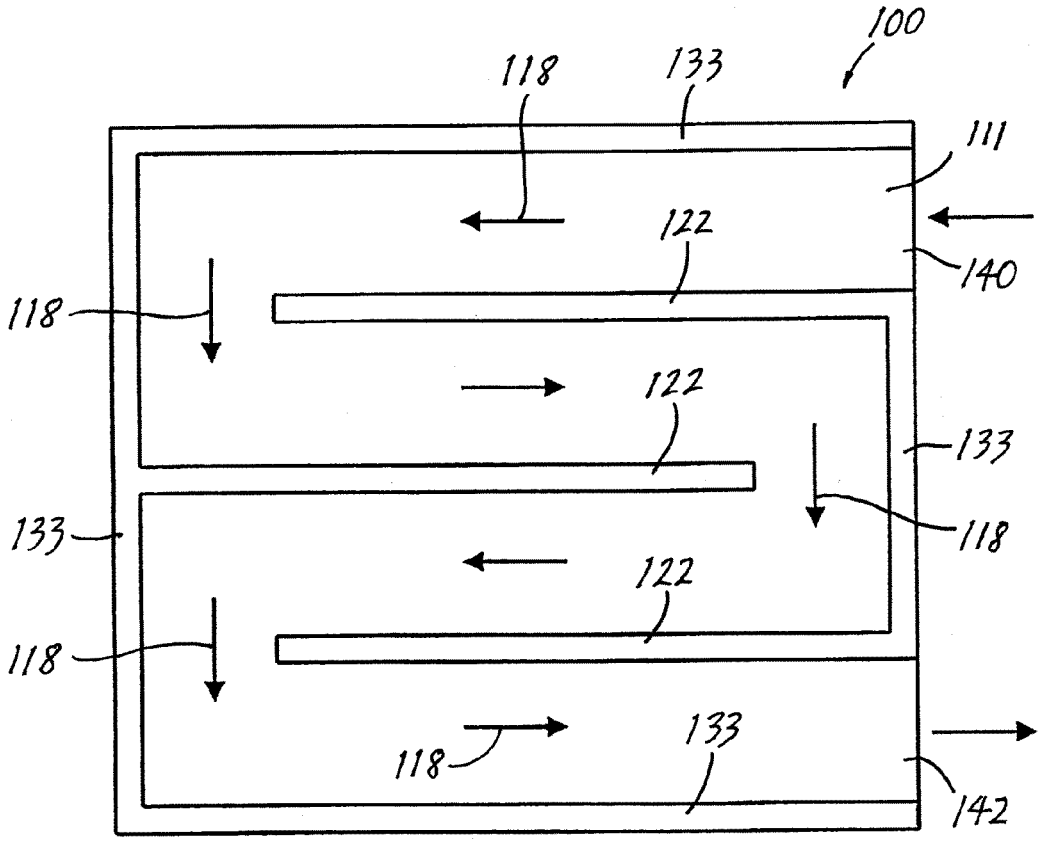
FIG. 5 is a top plan view of the single water heating compartment of FIG. 4.

FIGS. 4 and 5 show a basic structure of a water tank 100 of a water heating apparatus according to a first embodiment disclosed in the preset application. The water tank 100 may include a first or main heating member 111 mounted inside and across the water tank 100. The main heating member may be in the form of a flat plate having opposite first and second surfaces. The water tank 100 may include one or more secondary heating member 122 resting on the main heating element 111 and extending between and substantially perpendicular to the main heating member 111 and the sidewalls of the water tank 100. This forms a water compartment with a winding water path as best illustrated by the arrows 118 in FIG. 5. The water tank 100 may further include one or more tertiary heating member 133 mounted on an inner surface of the top, bottom and/or side walls of the water tank. In this embodiment, the water tank 100 is generally in the shape of a rectangular block, and the main, secondary and tertiary heating members 111, 122, 133 are generally rectangular in shape.

Although it has been shown in the present embodiment that there are three secondary heating members 122, it is understood that the water tank may contain one or more secondary heating members and may arrange in any possible way to form a winding water path inside the water tank. For example, the water tank 100 may have only one secondary heating member 122 forming a generally n-shaped water path. The secondary heating members 122 may be arranged parallel and/or perpendicular to one another.

Each of the first, secondary and tertiary heating members 111, 122, 133 may include a heating body made of ceramic glass in the form of a flat plate, at least a multi-layer conductive coating of nano-thickness deposited on the heating body, and ceramic frit electrodes coupled to the multi-layer conductive coating. The multi-layer conductive coating has a structure and composition which stabilize performance of the heating member at high temperature. It is appreciated that heat can be generated from the two opposite sides of the main heating member 111.

Figure 6:
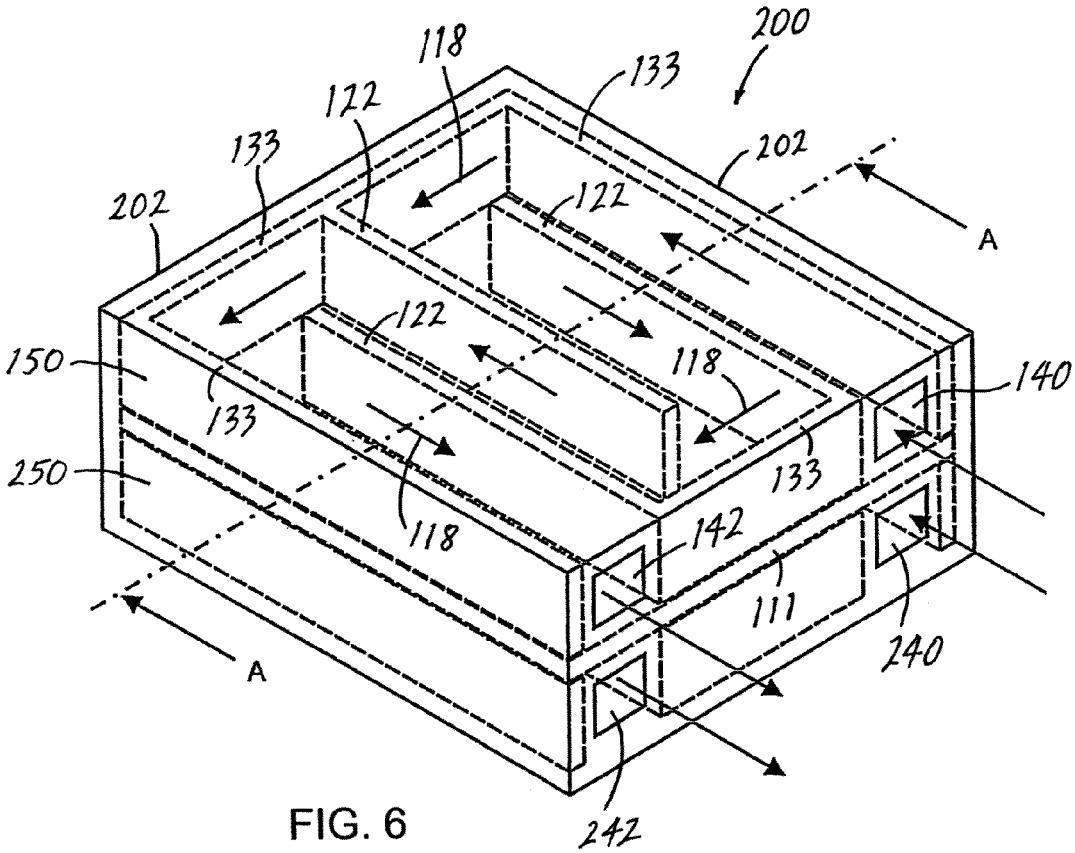
FIG. 6 is a perspective view of two water heating compartments of FIG. 4 being stacked one on top of the other.
Figure 7:
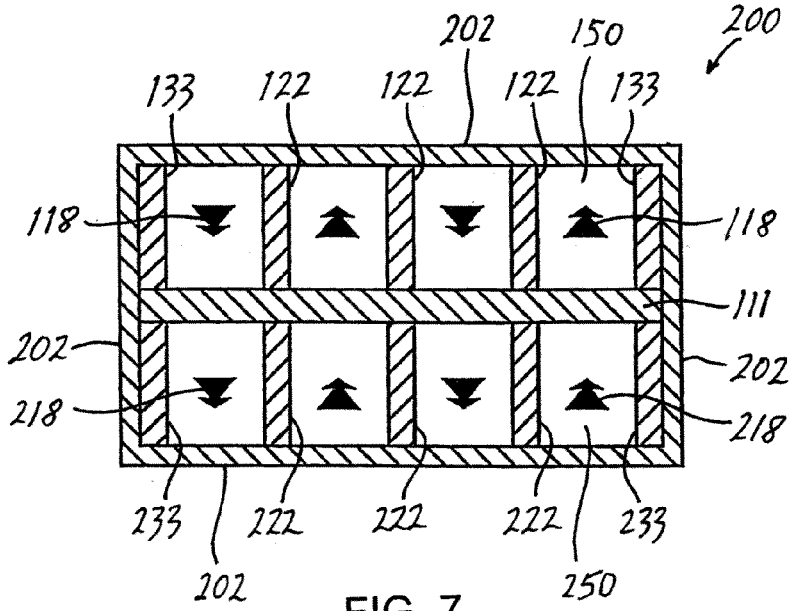
FIG. 7 is a cross-sectional view of the two water heating compartments taken along line A-A of FIG. 6.

FIGS. 6 and 7 show a water tank 200 having two water compartments 150, 250. The main heating member 111 is mounted inside and across the water tank 200 in the middle thereof. The water tank 200 may include two sets of secondary heating members 122 are mounted on the two opposite surfaces of the main heating member 111. The secondary heating members 122 extend between and substantially perpendicular to the main heating member 111 and the sidewalls 202 of the water tank 200. This forms the first water compartment 150 with a winding water path as illustrated by the arrows 118, and the second water compartment 250 with a winding water path as illustrated by the arrows 218. Each water compartment 150, 250 may further include a plurality tertiary heating member 133 mounted on the inner surface of the sidewalls 202 of the water tank 200.

Since the two water compartments 150, 250 are separated by the main heating member 11, each of the two compartments 150, 250 requires one water inlet and one water outlet. The water compartment 150 has a water inlet 140 and a water outlet 142, and the water compartment 250 has a water inlet 240 and a water outlet 242. As best illustrated in FIG. 7, the two water compartments 150, 250 are separated by the main heating member 111. In view of the fact that heat is generated from the two opposite surfaces of the main heating member 111, the utilization of heat energy generated from the main heating member 111 can be maximized.

Figure 8:
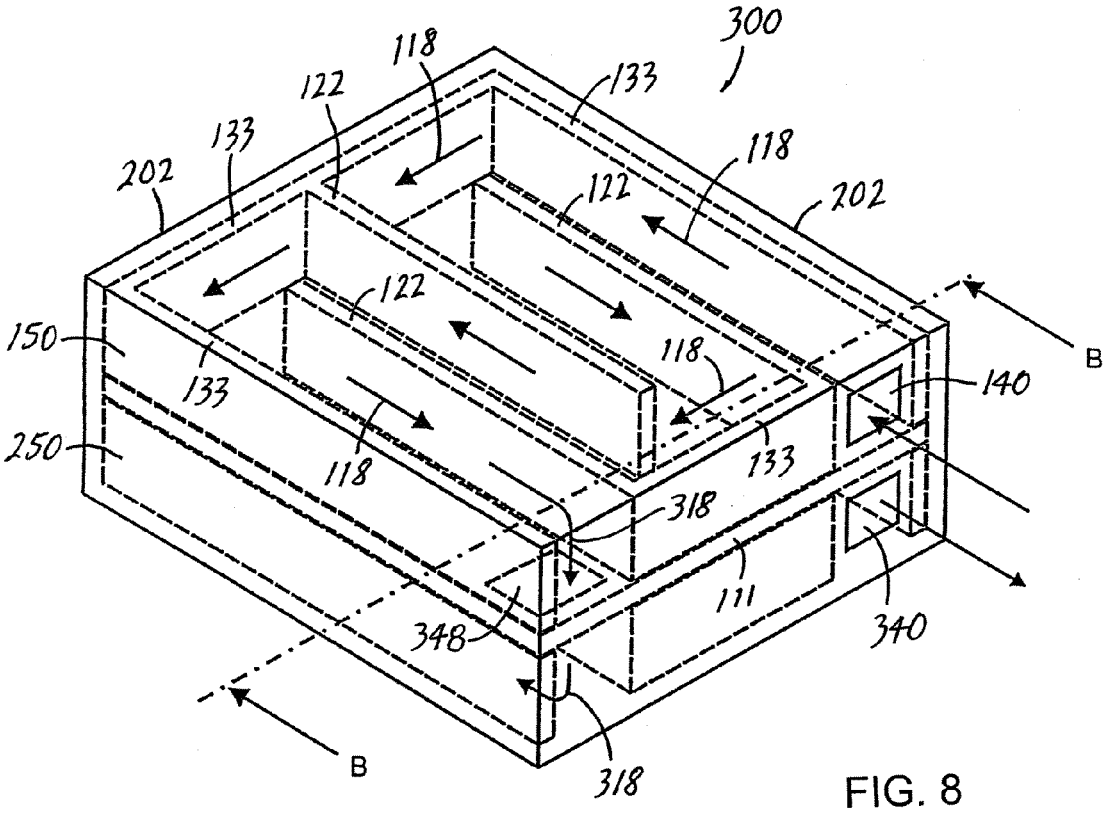
FIG. 8 is a perspective view of another embodiment of the two water heating compartments being stacked one on top of the other.
Figure 9:
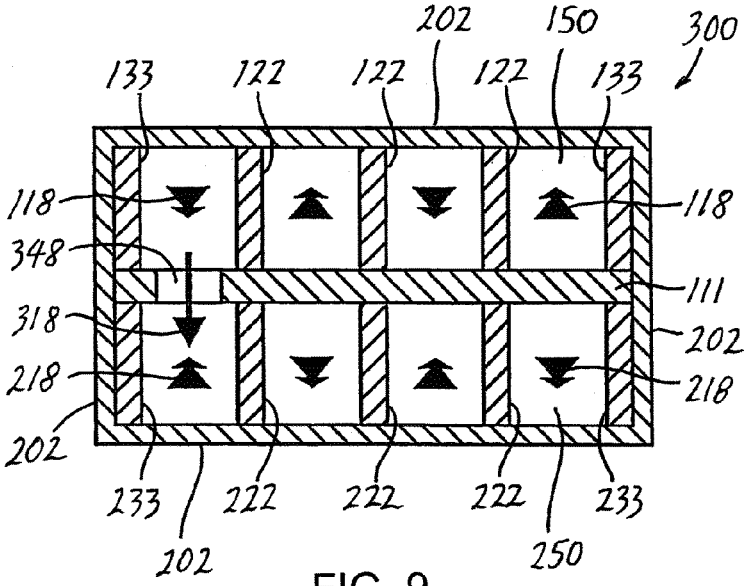
FIG. 9 is a cross-sectional view of the two water heating compartments taken along line B-B of FIG. 8

FIGS. 8 and 9 show a water heating apparatus 300 wherein the two water compartments 150, 250 are in fluid communication with each other by means of an opening 348 provided at a corner of the main heating member 111. It forms two continuing winding water paths 118 and 218. In this case, there is only one water inlet 140 and one water outlet 340. Water enters the water tank through the water inlet 140, flows through the winding water path 118 in the water compartment 150, flows from the water compartment 150 to the water compartment 250 in a direction indicated by the arrow 318, flows through the winding water path 218, and finally flows out of the water tank through the water outlet 340. In the present embodiment, the length of the water path is doubled. It can provide much higher energy to heat up the flowing water at a higher flow rate.

The main, secondary and tertiary heating members 111, 122, 133 may be electrically connected to one another in series or in parallel. The second and third heating members 122, 133 can be activatable independently of the main heating member 111. Therefore, one can increase or decrease the energy output by switching on or off the secondary and/or the tertiary heating members 122, 133 in the water tank. Furthermore, the main, secondary and tertiary heating members 111, 122, 133 can be removably mounted inside the water tank. Each of the main, secondary and tertiary heating members 111, 122, 133 may include a plurality of conductive coatings electrically connected to one another in series or in parallel.

In practical uses, the hot water can be operated in different modes, namely high energy efficiency mode and high performance mode. A high energy efficiency mode is an operation mode in which only the main heating member 111 and/or some of the secondary heating members 122 which are fully immersed with water in the water path are switched on. Energy released on both sides of these heating members can effectively take up by the flowing water along the water path. A high energy efficiency of above 99% can be achieved in this operation mode. A high performance mode is an operation mode in which the main heating member 111, the secondary heating members 122 and the tertiary heating members 133 are all switched on such that the flowing water will take up energy from the three dimensional directions of top, bottom and sides along the water path. The energy inputs to the flowing water can be maximized and the desired temperature can be reached instantly in a very short period.

In contrary to the tube or coil heating elements used in conventional hot water heaters, in which water is flowing along the heating element and receives heat energy from a heating element only once along a defined direction. The water heating apparatus disclosed in the present application provides an alternative path for the flowing water in receiving heat energy from the main heating member 111 at a much higher efficiency. The water flows along a winding path over the flat surface of the main heating member 111 and repeatedly receives heat energy from the main heating member when the water continues to flow along the water path. The main heating member 111 can have a size of about 20 cm×20 cm. In the water path configuration as shown in FIGS. 4 and 5, a water heating path of a distance over 80 cm can be achieved on a compact sized water tank.

Figure 10:
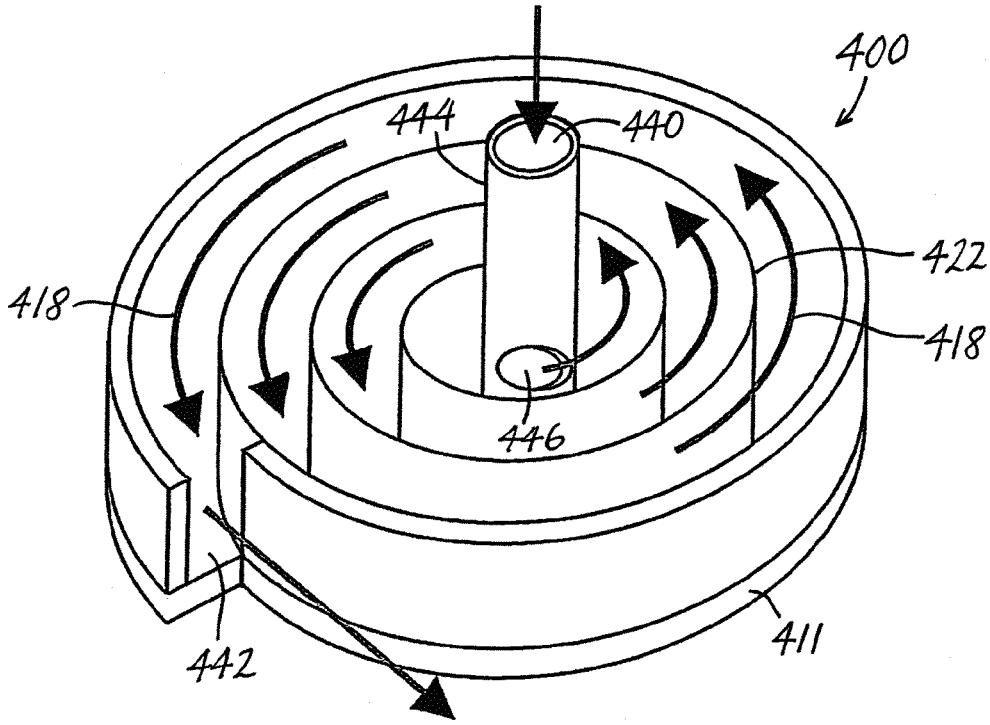
FIG. 10 is a perspective view of a single water heating compartment according to a second embodiment disclosed in the present application.
Figure 11:
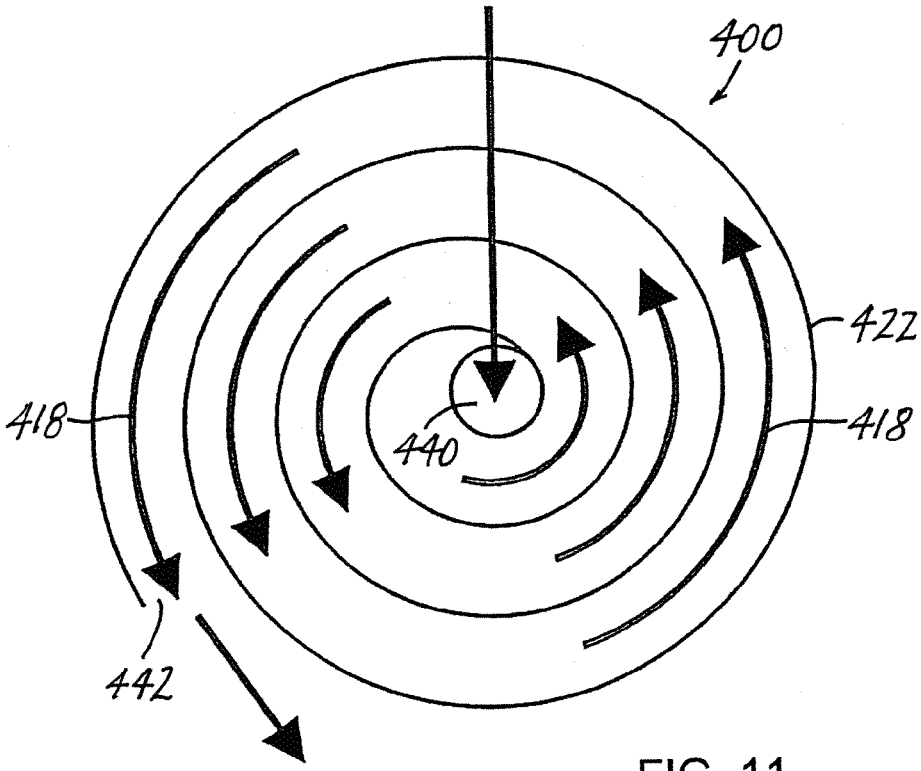
FIG. 11 is a top plan view of the single water heating compartment of FIG. 10.

FIGS. 10 and 11 show a basic structure of a water tank 400 of a water heating apparatus according to a second embodiment disclosed in the preset application. A first heating member 411 can be mounted inside and across the water tank 400. The first heating member 411 may be in the form of a flat plate having opposite first and second surfaces.

A spiral second heating member 422 rests on the first heating member 411 and extends between and substantially perpendicular to the heating member 411 and the sidewalls of the water tank. This forms a water compartment 450 with a spiral water path indicated by the arrows 418. The spiral second heating member 422 serves as a partition member to define the water path in the water compartment.

The first heating member 411 may include a heating body made of ceramic glass, at least a multi-layer conductive coating of nano-thickness deposited on the heating body, and ceramic frit electrodes coupled to the multi-layer conductive coating, wherein the multi-layer conductive coating includes a structure and composition which stabilize performance of the heating member at high temperature.

The water heating apparatus 400 may include a pipe 444 with one end being connected to an innermost end of the spiral second heating member 422 and in fluid communication with the water compartment 450 by means of a side opening 446 formed on the pipe 444. The pipe 444 defines a water inlet 440 and an outermost end of the spiral second heating member 422 defines a water outlet 442 of the water tank 400.

Similar to the previous embodiment, the water tank may further include one or more tertiary heating member mounted on an inner surface of the top, bottom and/or side walls of the water tank.

Figure 12:
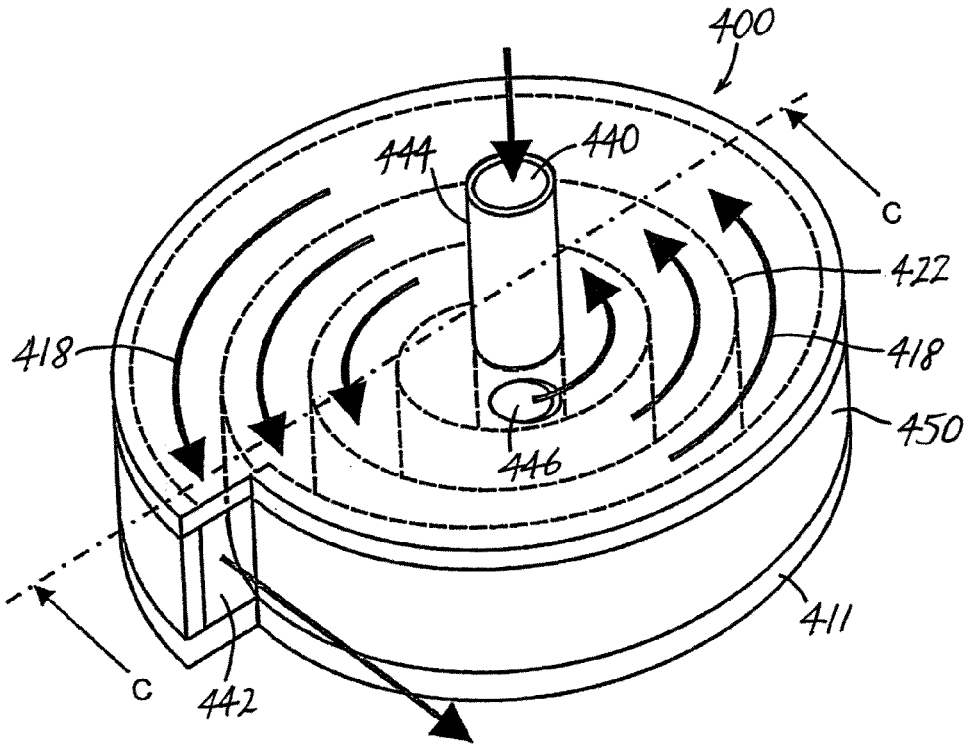
FIG. 12 is a perspective view of the single water heating compartments similar to the one shown in FIG. 10.
Figure 13:
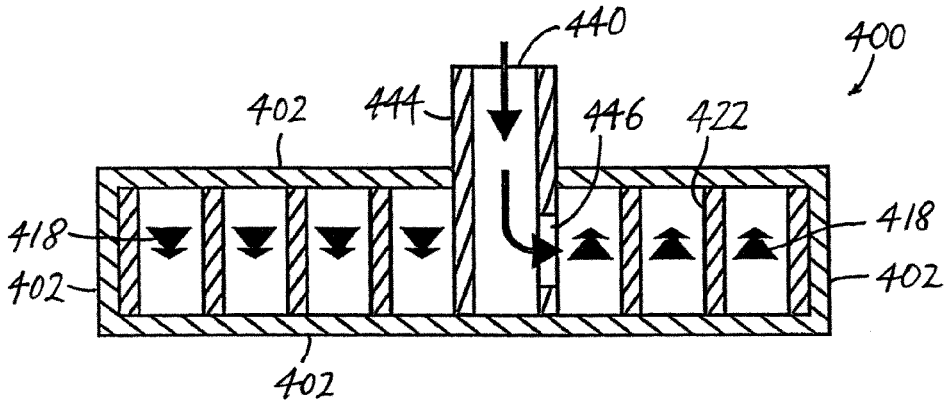
FIG. 13 is a cross-sectional view of the single water heating compartments taken along line C-C of FIG. 12.

FIGS. 12 and 13 show one spiral second heating member 422 provided in the water tank 400 defined by sidewalls 402 and forming one water compartment 450 with a spiral water path indicated by the arrows 418. With the water path configuration as shown in FIGS. 12 and 13, a water heating path with a distance of about 125 cm can be achieved on the main heating member 411.

Figure 14:
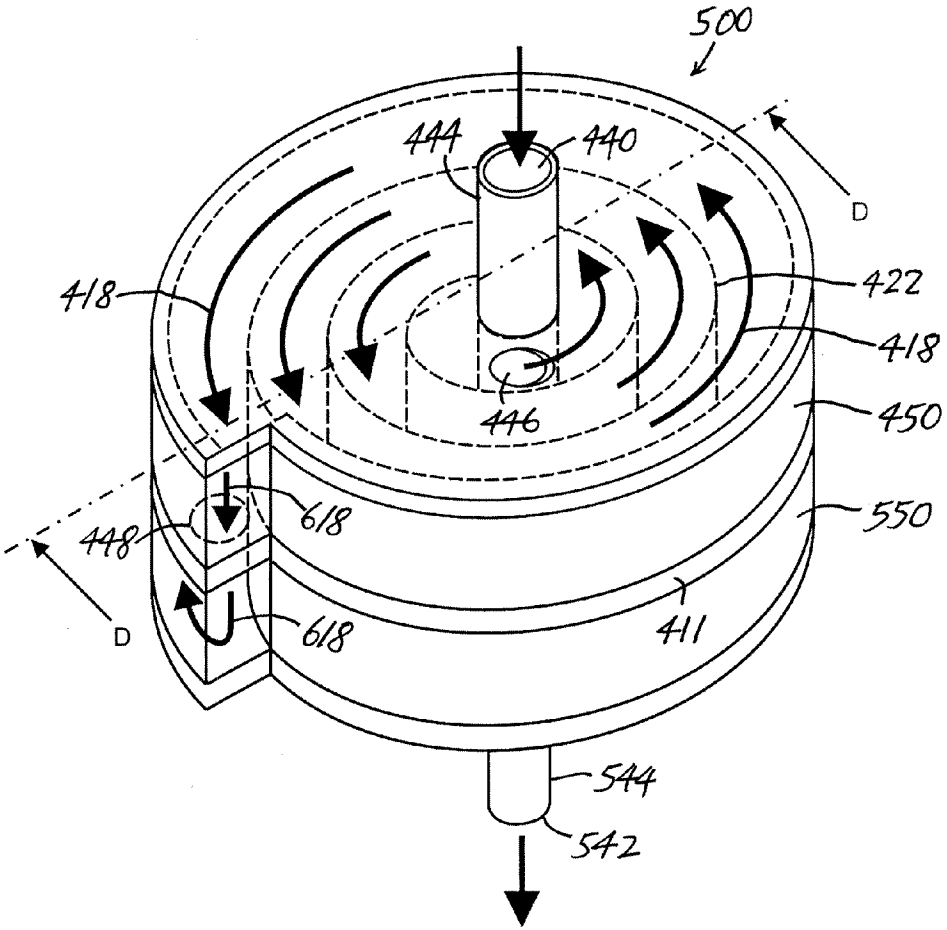
FIG. 14 is a perspective view of two water heating compartments of FIG. 10 being stacked one on top of the other.
Figure 15:
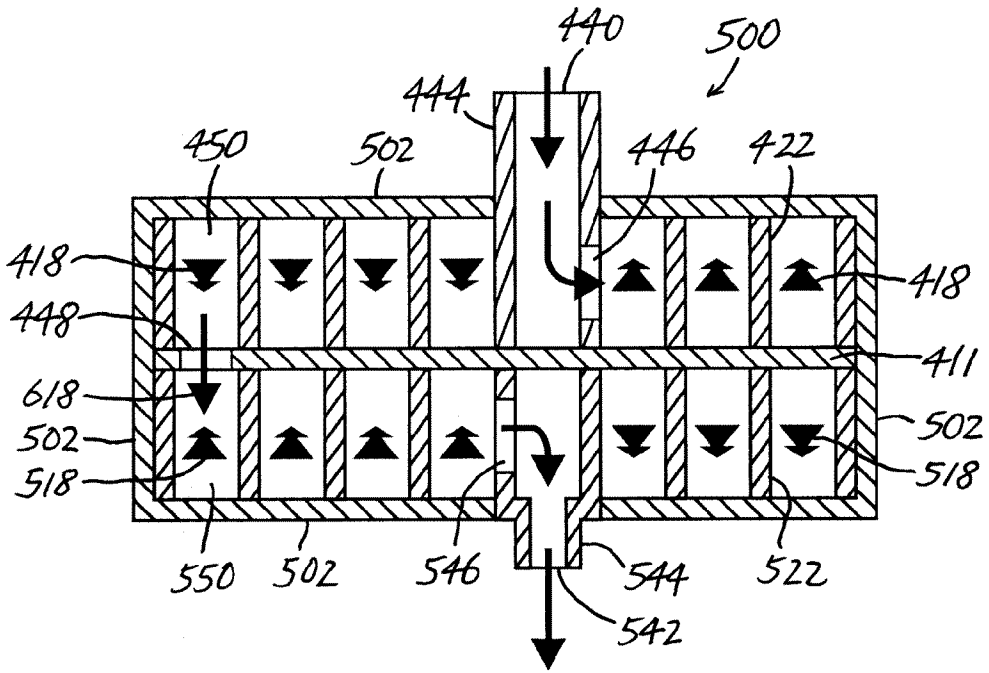
FIG. 15 is a cross-sectional view of the two water heating compartments taken along line D-D of FIG. 14.

FIGS. 14 and 15 show two spiral second heating members 422, 522 provided on the two opposite surfaces of the first heating member 411 extending across the water tank in a middle portion thereof and forming two water compartments 450, 550 with two spiral water paths indicated by the arrows 418 and 518 respectively.

According to the illustrated embodiment, the two water compartments 450, 550 may be in fluid communication with each other by means of an opening 448 provided on the first heating member 411 forming two continuing spiral water paths 418, 518.

A second pipe 544 with one end being connected to an innermost end of the second spiral second heating member 522 and in fluid communication with its associated water compartment 550 by means of a side opening 546 formed on the second pipe 544, wherein the first pipe 444 defines a water inlet 440 and the second pipe 544 defines a water outlet 542 of the water tank 500.

According to the illustrated embodiment, the water tank 400, 500 is generally cylindrical in shape and the heating member 411 is generally circular in shape. Power output or energy consumption of the water heating apparatus can be increased or decreased by increasing or reducing the number of heating members in the water heating apparatus. To achieve this, simply add more heating members to the water heating apparatus, or remove some of the heating members from the water heating apparatus, or disconnecting the power supply to some of the heating members. In practical uses, the water heating apparatus can be configured with a small number of heating members of a large heating area or a larger number of heating members with smaller heating area, depending upon the requirements for heating output.

Figure 14A:
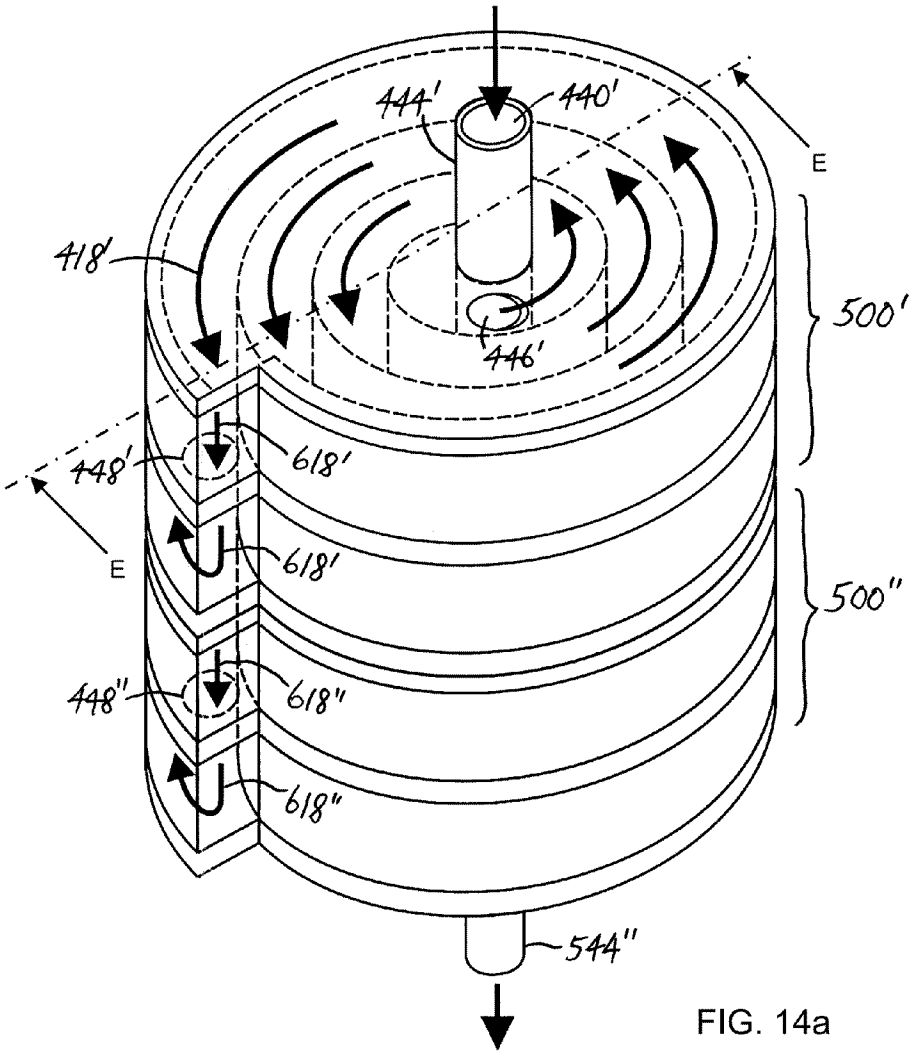
FIG. 14*a* is a perspective view of two of the water heating modules shown in FIG. 14 being stacked one on top of the other.
Figure 15A:
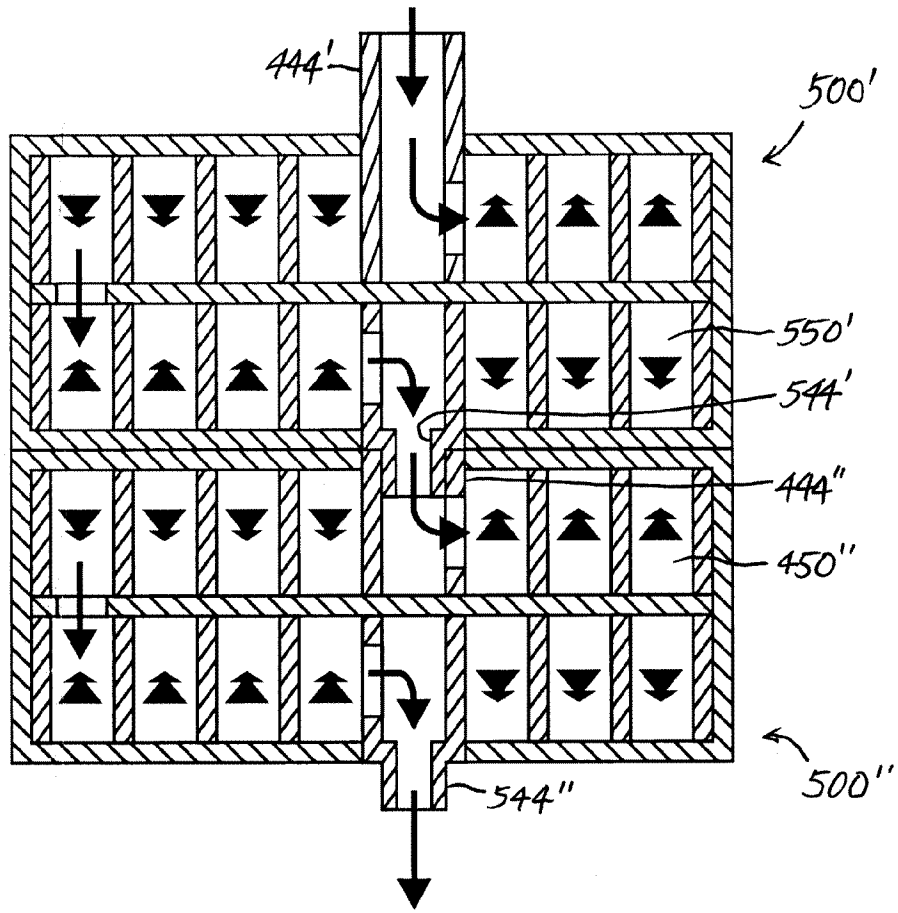
FIG. 15*a* is a cross-sectional view of the two water heating modules taken along line E-E of FIG. 14*a*.

The water heating apparatus of the present invention can be built in modules, thus its water heating capacity can be easily increased by simply stacking and integrating the modules together. An embodiment of two water heating modules 500' and 500", each of which contains two water heating compartments, is presented in FIG. 14*a* and the passage of water flow in the water heating apparatus is presented in FIG. 15*a*. The water heating capacity can be increased or decreased by stacking or removing the water heating modules in accordance with the water output demands. The water flow outputs for a defined water temperature can be easily reached with a higher number of water heating modules stacking together. The structure of the water heating modules 500' and 500" is the same as that of the water heating module 500 in FIG. 14. The water heating module 500' can be stacked on top of the water heating module 500" by simply inserting the lower water pipe 544' of the water heating module 500' into the upper water pipe 444" of the water heating module 500" so that water can flow from the lower water compartment 550' of the upper water heating module 500' to the upper water compartment 450" of the lower water heating module 500".

The water heating apparatus can also increase or decrease its power output or energy consumption by increasing or reducing the power capacity of each individual heating member. The power capacity of each heating member can be improved by the increase of the conductivity of the conductive coatings 16, 16' through changing their compositions, coating areas, process conditions and connections. Using split coating areas and electrode connections, high wattage density power output over small area can be achieved with a.c. power supply. Heating members with high wattage density can be developed. Improvement of electrical conductivity of a heating member and its power output can be achieved by arranging the conductive coatings 16, 16' in a parallel connection configuration. For example, a heating member contains five conductive coatings 16, 16', each can generate a power rating of about 1000 W using a.c. power. Each conductive coatings 16, 16' can be used individually or function together to generate a total power output of about 5000 W. These conductive coatings 16, 16' in a sealed laminate form are waterproof and can perform high efficiency water heating in electric kettles and hot water heaters, with capacity to outperform the conventional hot water heaters.

Figure 16:
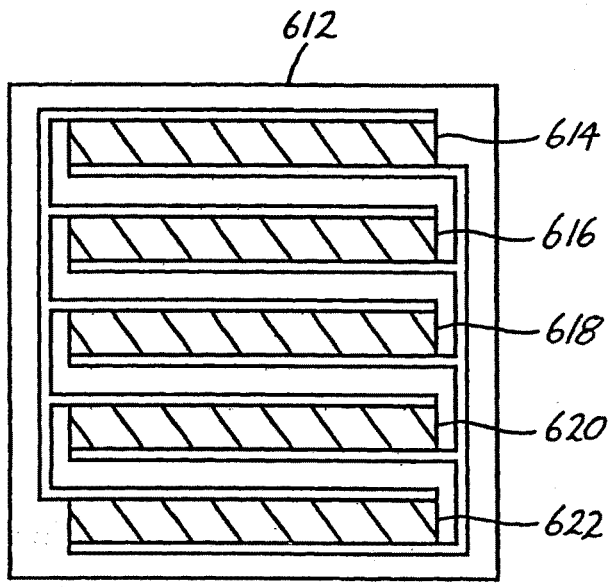
FIG. 16 is a heating member having five conductive coatings in a parallel connection.

FIG. 16 shows a parallel connection of five conductive coatings 614, 616, 618, 620, 622 in a heating member 612 that can reduce the electrical resistance of the heating member 612 to below 10 ohms. With an electrical resistance of 10 ohms, at an a.c. voltage of 220V, a power rating of 4840 W can be generated by a single heating member.

Figure 17:
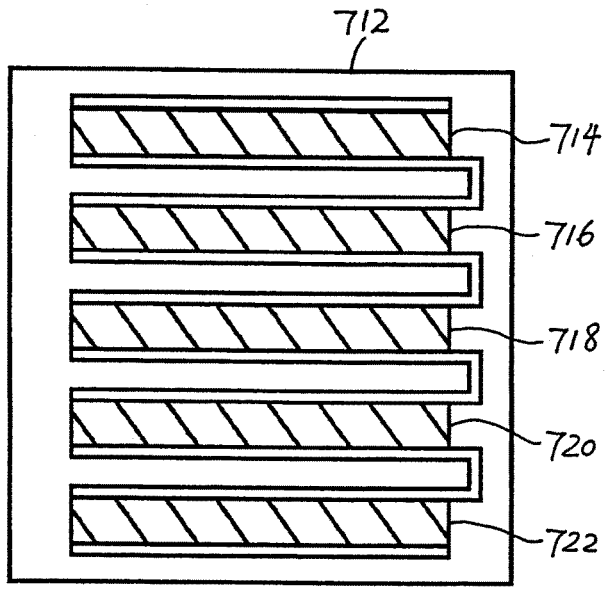
FIG. 17 is a heating member having five conductive coatings in a series connection.

The conductive coatings can also be connected in series. FIG. 17 shows a series connection of five conductive coatings 714, 716, 718, 720, 722 in a heating member 712. With each conductive coating of electrical resistance of 2 ohms, an electrical resistance of 10 ohms is achieved in the series connection of the five conductive coatings. At an a.c. voltage of 220V, a power rating of 4840 W can be generated by a single heating member.

Figure 18:
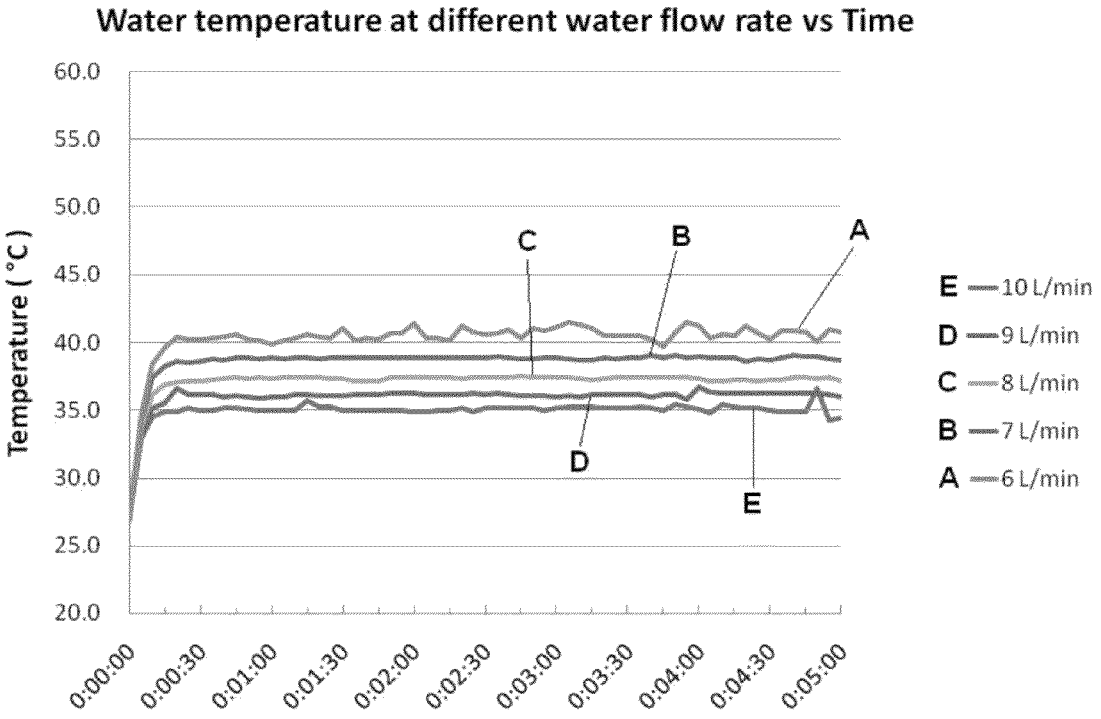
FIG. 18 is a plot of increase of water temperature at a total power output of about 9 kW from three heating members, each of power output of about 3 kW.
Figure 19:
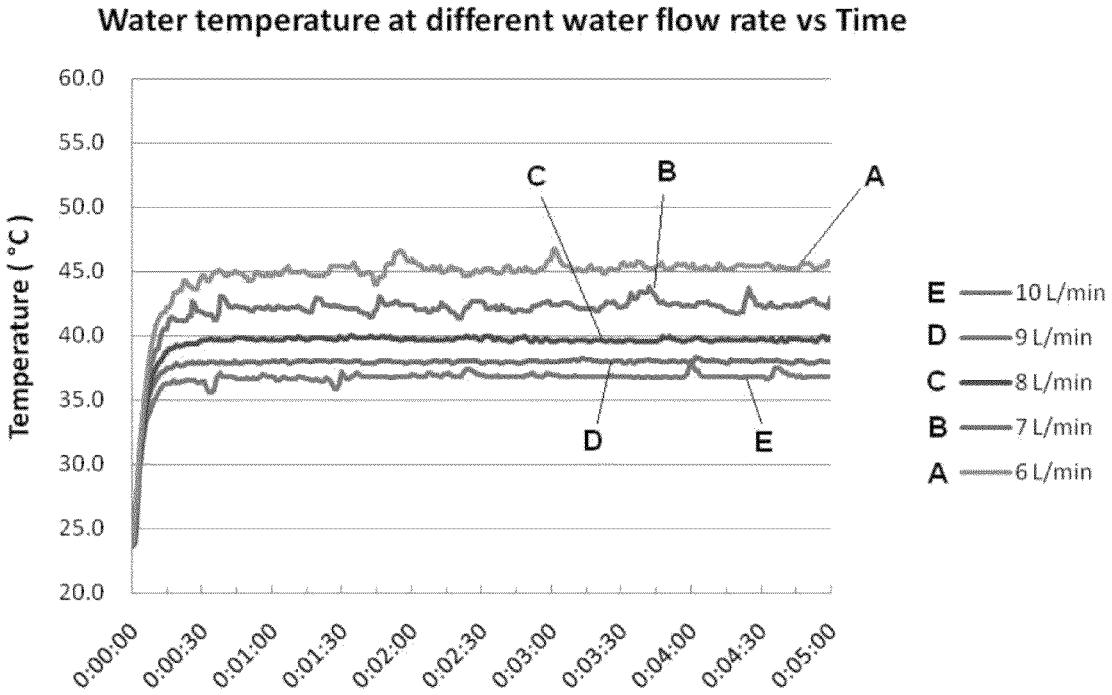
FIG. 19 is a plot of increase of water temperature at a total power output of about 6 kW with two heating members, each of power output of about 3 kW.

With the ceramic glass heating members of this application, fast instant water heating in the apparatus can be achieved. FIGS. 18 and 19 show the rise of water temperature at different water flow rates and power ratings. FIG. 18 is a plot of the results generated from a total power output of about 9 kW with three heating members, each of power output of about 3 kW. FIG. 19 is a plot of the results from a total power output of about 6 kW with two heating members, each of power output of about 3 kW. It is demonstrated that with a 3-phase power output of about 9 kW, a temperature rise of about 20° C. can be achieved within about 20 seconds at a water flow rate of 6 liters per minute. A steady water temperature at 44° C. can be achieved thereafter. The rise of water temperature was affected by the water flow rate. At a higher water flow rate of 10 liters per minute, water temperature rise is about 12° C. in 20 seconds, and then the water temperature becomes steady at 36° C. With two single phase heating members of a total of about 6 kW power output, some change on the heating performance can be observed. At a water flow rate of 6 liters per minute, a rise of water temperature of 13° C. can be achieved in 20 seconds and water temperature can be steady at about 40° C. At a water flow rate of 10 liters per minute, water temperature rise is about 8° C. in 20 seconds and water temperature is steady at 35° C. For most popular brand hot water heaters currently available in the commercial market, with a single phase power of 6 kW, a water temperature of 40° C. can be achieved at a much lower water flow rate of 3 liters per minute for kitchen uses. In general a minimum water flow rate of 5 liters per minute is required for bath showers.

The power monitor and control system 14 using ADC (analog-to-digital converter) and PWM (pulse-width modulation) drives can be integrated with the conductive coatings in smoothing the power supply to the heating members, in accordance with the flow rate and temperature of water and optimizing the heating performance and energy saving efficiency of the heating members.

Figure 20:
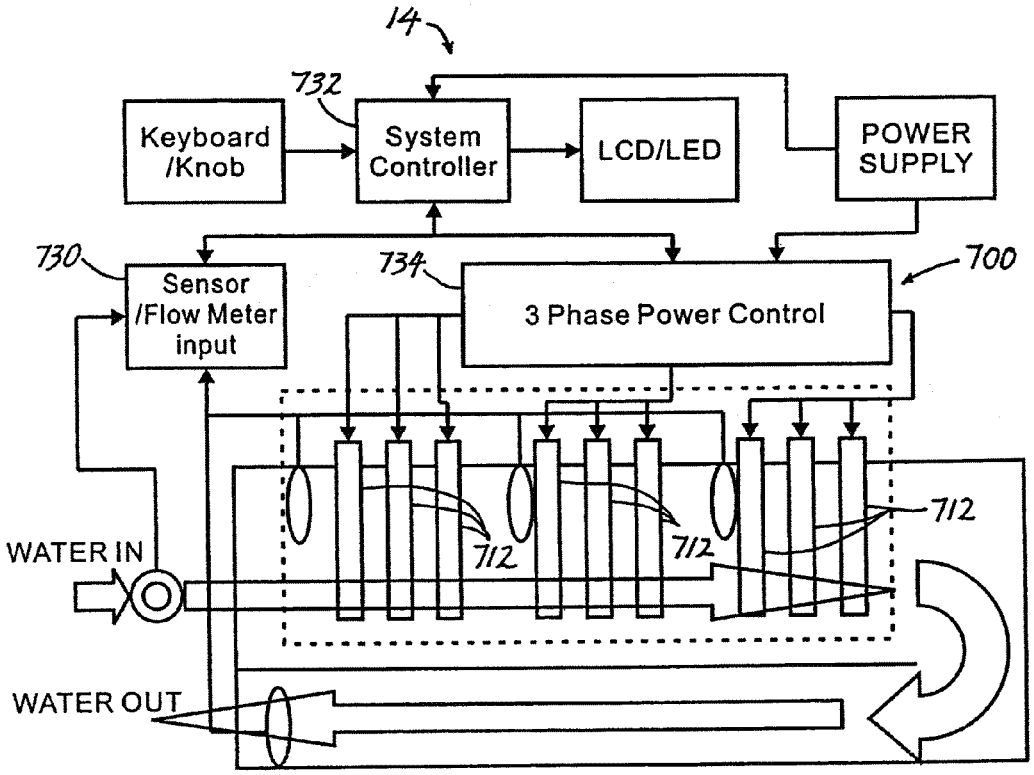
FIG. 20 is a block diagram of a 3-phase a.c. powered water heater system consisting of nine heating members.
Figure 21:
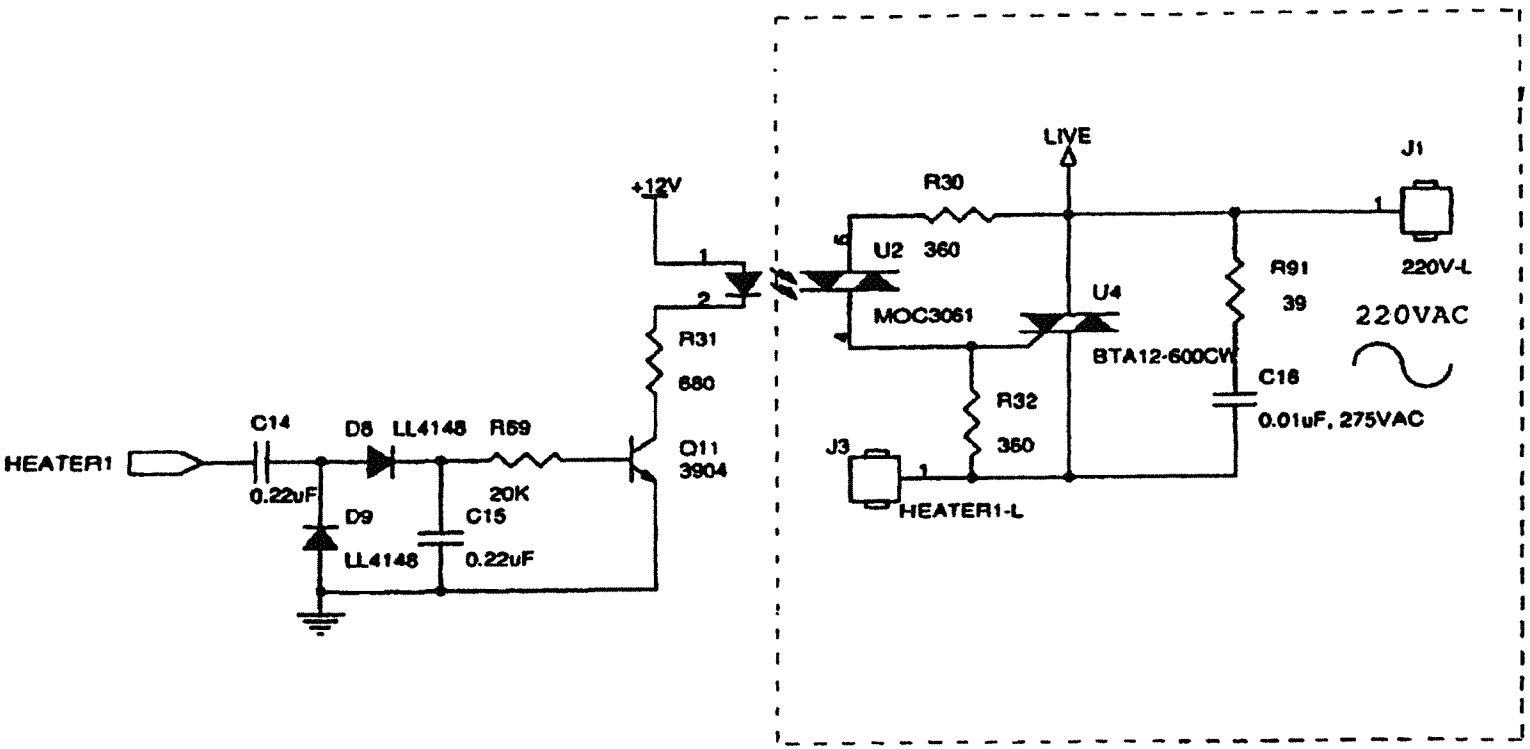
FIG. 21 is a circuitry diagram of a monitoring connection to power supply.
Figure 22:
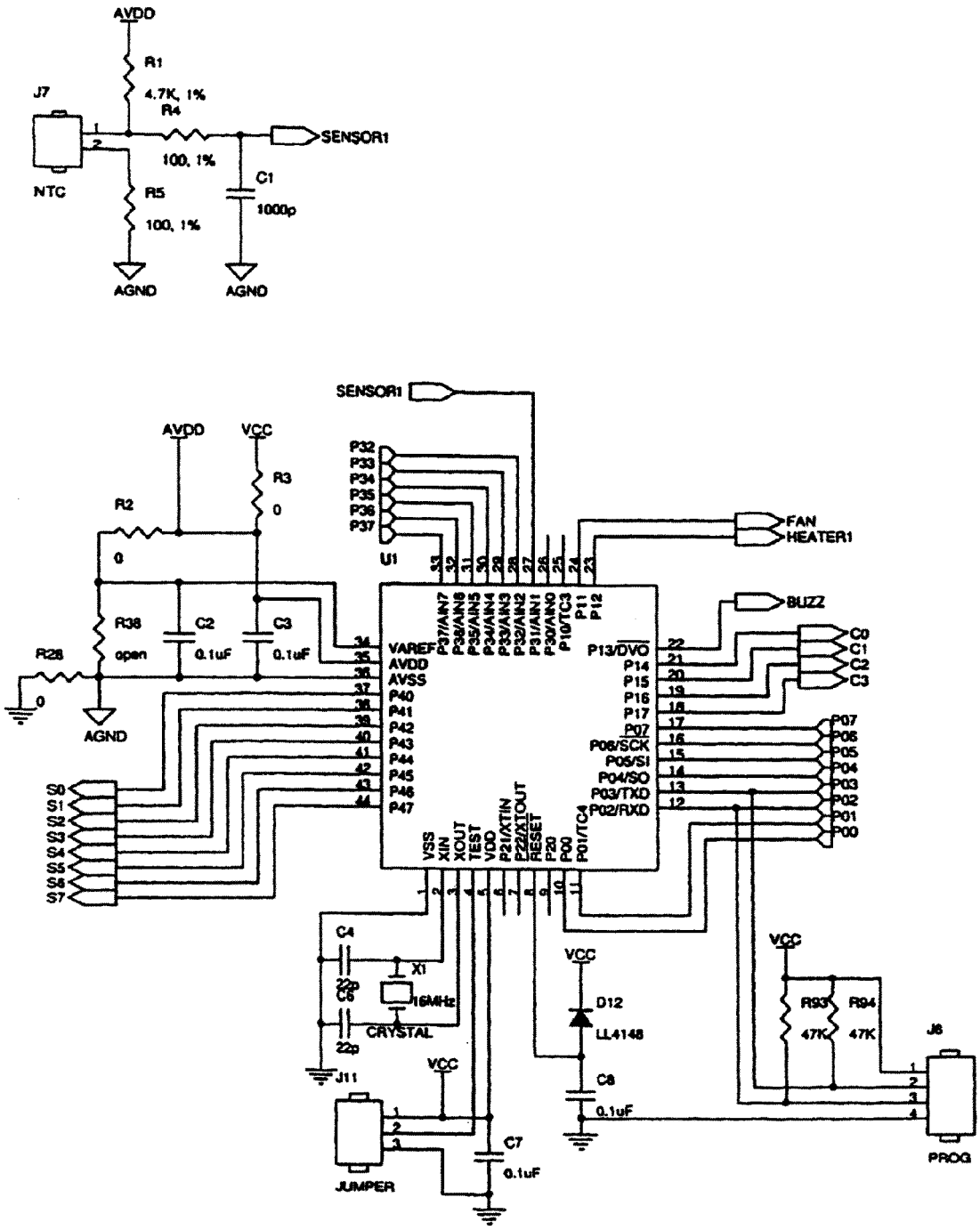
FIG. 22 is a circuitry diagram of the ADC and PWM drives of a power monitor and control system.

FIG. 20 is a block diagram of a 3-phase a.c. powered water heater system 700 consisting of nine heating members 712. Temperature sensor and flow meter 730 may be integrated with the system controller 732 of the power control 734 in accordance with preset conditions of water temperature and water flow rate in use. In particular, the power monitor and control system 14 using ADC and PWM drives may be integrated with the nano-thickness heating films in smoothing the power supply to the heating members and optimizing their heating performance and energy saving efficiency. The power monitor and control system 14 may be integrated with the conductive coatings for optimum temperature and energy saving control. Driving software and controller using ADC for temperature measurement and PWM for precise power control may be integrated with the heating members with the circuitry as shown in FIGS. 21 and 22. With this monitor and control system 14, a kind of heating servo system can be developed to match with and optimize the fast and efficient heating characteristics of the conductive coatings of nano-thickness in achieving fast heating up time (within 1 minute), accurate temperature target (±2° C.) and maximum energy savings (of efficiency up to 95%). When the water reaches the preset target temperature, the ADC and PWM control system will immediately respond and cut off power supply for energy saving purpose and restricting offshoot of the conductive coating temperature. When the water temperature falls below the preset temperature, ADC and PWM will then respond and switch on power supply for heat generation. The servo system therefore can provide continuous monitoring and controlling with fast responses in smoothing the power supply to the heating members and optimizing their heating performance and energy saving efficiency.

While the water heating apparatus disclosed in the present application has been shown and described with particular references to a number of preferred embodiments thereof, it should be noted that various other changes or modifications may be made without departing from the scope of the appending claims.

What is claimed is:

1. A water heating apparatus comprising:

a water tank comprising a plurality of sidewalls;

a first heating member mounted inside and across the water tank, the first heating member being in the form of a flat plate comprising opposite first and second surfaces;

at least one second heating member resting on the first heating member and extending between and substantially perpendicular to the first heating member and the sidewalls, forming at least one water compartment with a winding water path; and at least one third heating member mounted on an inner surface of the top, bottom or sidewalls of the water heating apparatus;

each of the first, second and third heating members comprising:

a heating body made of ceramic glass in the form of a flat plate;

at least a multi-layer conductive coating of nano-thickness deposited on the heating body; and electrodes coupled to the multi-layer conductive coating.

2. The water heating apparatus as claimed in claim 1, comprising at least two second heating members provided on the two opposite surfaces of the first heating member, forming two water compartments with two winding water paths respectively.

3. The water heating apparatus as claimed in claim 2, wherein the two water compartments are in fluid communication with each other by an opening provided on the first heating member, forming a continuing winding water path doubling the length of the water path of a single water compartment.

4. The water heating apparatus as claimed in claim 1, wherein each of the first, second and third heating members comprises a plurality of conductive coatings electrically connected to one another in series or in parallel.

5. A water heating apparatus comprising:

a water tank comprising a plurality of sidewalls;

a first heating member mounted inside and across the water tank, the heating member being in the form of a flat plate comprising opposite first and second surfaces;

at least one spiral second heating member resting on the first heating member and extending between and substantially perpendicular to the first heating member and the sidewalls, forming at least one water compartment with a spiral water path;

at least one third heating member mounted on an inner surface of the top, bottom or sidewalls of the water heating apparatus;

each of the first, second and third heating members comprising:

a heating body made of ceramic glass;

at least a multi-layer conductive coating of nano-thickness deposited on the heating body; and electrodes coupled to the multi-layer conductive coating.

6. The water heating apparatus as claimed in claim 5, further comprising a pipe with one end being connected to an innermost end of the spiral second heating member and in fluid communication with the water compartment by a side opening formed on the pipe, and wherein the pipe defines a water inlet and an outermost end of the spiral second heating member defines a water outlet of the water tank.

7. The water heating apparatus as claimed in claim 5, comprising two spiral second heating members provided on the two opposite surfaces of the first heating member, forming two water compartments with two spiral water paths respectively.

8. The water heating apparatus as claimed in claim 7, wherein the two water compartments are in fluid communication with each other by an opening provided on the first heating member, forming a continuing spiral water path doubling the length of water path of a single water compartment.

9. The water heating apparatus as claimed in claim 8, further comprising a first pipe with one end being connected to an innermost end of one spiral second heating member and in fluid connection communication with one corresponding water compartment through a side opening formed on the first pipe; and a second pipe with one end being connected to an innermost end of the other spiral second heating member and in fluid communication with the other corresponding water compartment through a side opening formed on the second pipe, wherein the first pipe defines a water inlet and the second pipe defines a water outlet of the water tank.

10. The water heating apparatus as claimed in claim 5, wherein each of the first, second and third heating members comprises a plurality of conductive coatings electrically connected to one another in series or in parallel.

11. The water heating apparatus as claimed in claim 5, wherein the water tank is generally cylindrical in shape and the first heating member is generally circular in shape.

12. A water heating apparatus comprising:

a water tank comprising a plurality of sidewalls;

a first heating member mounted inside and across the water tank, the first heating member being in the form of a flat plate comprising opposite first and second surfaces;

at least one partition member resting on the first heating member and extending between the first heating member and the sidewalls to form at least one water compartment with a water path;

wherein the first heating member comprises:

a heating body;

at least a multi-layer conductive coating of nano-thickness deposited on the heating body; and electrodes coupled to the multi-layer conductive coating.

13. The water heating apparatus as claimed in claim 12, wherein the partition member comprises a second heating member, which comprises: a heating body; at least a multi-layer conductive coating of nano-thickness deposited on the heating body; and electrodes coupled to the multi-layer conductive coating, wherein the multi-layer conductive coating comprises a structure and composition which stabilize performance of the heating member at high temperature.

14. The water heating apparatus as claimed in claim 13, further comprising at least one third heating member mounted on an inner surface of the sidewalls, wherein the third heating member comprises: a heating body; at least a multi-layer conductive coating of nano-thickness deposited on the heating body; and electrodes coupled to the multi-layer conductive coating, wherein the multi-layer conductive coating comprises a structure and composition which stabilize performance of the heating member at high temperature.

15. The water heating apparatus as claimed in claim 14, wherein each of the first, second and third heating members comprises a plurality of conductive coatings electrically connected to one another in series or in parallel.

16. The water heating apparatus as claimed in claim 12, comprising one partition member resting on the first heating member and forming a generally n-shaped water path in the water tank.

17. The water heating apparatus as claimed in claim 12, comprising a plurality of partition members resting on the first heating member and arranged parallel to one another forming a winding water path in the water tank.

18. The water heating apparatus as claimed in claim 12, wherein the water tank is generally cylindrical in shape and the first heating member is generally circular in shape.

19. The water heating apparatus as claimed in claim 12, comprising at least two partition members provided on the two opposite surfaces of the first heating member, forming two water compartments with two water paths respectively.

20. The water heating apparatus as claimed in claim 19, wherein the two water compartments are in fluid communication with each other by an opening provided on the first heating member, forming a continuing water path doubling the length of the water path of a single water compartment.

21. The water heating apparatus as claimed in claim 12, wherein the at least one partition member is spiral in shape forming at least one water compartment with a spiral water path.

22. The water heating apparatus as claimed in claim 21, further comprising a pipe with one end being connected to an innermost end of the spiral partition member and in fluid communication with the water compartment by a side opening formed on the pipe, and wherein the pipe defines a water inlet and an outermost end of the spiral partition member defines a water outlet of the water tank.

23. The water heating apparatus as claimed in claim 21, comprising two spiral partition members provided on the two opposite surfaces of the heating member, forming two water compartments with two spiral water paths respectively.

24. The water heating apparatus as claimed in claim 23, wherein the two water compartments are in fluid communication with each other by an opening provided on the heating member, forming a continuing spiral water path doubling the length of the water path of a single.

25. The water heating apparatus as claimed in claim 24, further comprising a first pipe with one end being connected to an innermost end of one spiral partition member and in fluid communication with its associated compartment by a side opening formed on the first pipe; and a second pipe with one end being connected to an innermost end of the other spiral partition member and in fluid communication with its associated water compartment by means of a side opening formed on the second pipe, wherein the first pipe defines a water inlet and the second pipe defines a water outlet of the water tank.

* * * * *